US007833062B2

(12) United States Patent
Zhou et al.

(10) Patent No.: US 7,833,062 B2
(45) Date of Patent: Nov. 16, 2010

(54) PHONE JACK CONNECTOR

(75) Inventors: Hai-Jie Zhou, Taoyuan Hsien (TW); Benyb Lee, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 12/388,106

(22) Filed: Feb. 18, 2009

(65) Prior Publication Data

US 2010/0136845 A1 Jun. 3, 2010

(30) Foreign Application Priority Data

Nov. 28, 2008 (TW) ..... 97146080 A

(51) Int. Cl.
*H01R 13/648* (2006.01)

(52) U.S. Cl. ..... 439/620.23; 439/620.22

(58) Field of Classification Search ..... 439/620.11, 439/620.17, 620.18, 620.23, 620.22
See application file for complete search history.

(56) References Cited

U.S. PATENT DOCUMENTS

2004/0110422 A1* 6/2004 Sasai et al. ..... 439/620
2005/0181643 A1* 8/2005 Brower et al. ..... 439/76.1

* cited by examiner

*Primary Examiner*—Gary F. Paumen
(74) *Attorney, Agent, or Firm*—Muncy, Geissler, Olds & Lowe, PLLC

(57) ABSTRACT

A connector includes an insulating housing and at least one inserting pin. The insulating housing includes at least one groove and at least one plug receiving hole. The inserting pin penetrates through the groove, and is secured by a sidewall of the groove. The inserting pin includes a resilient leg for being electrically connected to a plug received in the insulating housing.

16 Claims, 2 Drawing Sheets

PHONE JACK CONNECTOR

CROSS REFERENCE TO RELATED APPLICATIONS

This Non-provisional application claims priority under 35 U.S.C. §119(a) on Patent Application No(s). 097146080 filed in Taiwan, Republic of China on Nov. 28, 2008, the entire contents of which are hereby incorporated by reference.

BACKGROUND OF THE INVENTION

1. Field of Invention

The present invention relates to a phone jack connector which can reduce the manufacturing time, the size and the manufacturing cost.

2. Related Art

Nowadays in RJ11 connector or RJ45 connector, the signal inserting pin and connecting pin of conventional RJ11 connectors or RJ45 connectors fixed and positioned onto the bracket. Then, the bracket is assembled at a rear side of the insulating housing to form a RJ11 connector or a RJ45 connector.

However, it is necessary in the above-mentioned process to manufacture the bracket, position and fix the signal inserting pin and the connecting pin with the bracket, and to provide the space of the insulating housing for accommodating the bracket. Thus, the manufacturing time, cost and size of RJ11 connector or RJ45 connector cannot be greatly decreased.

SUMMARY OF THE INVENTION

An object of the present invention is to provide a a phone jack connector for reducing the manufacturing time, size and cost.

To achieve the above, the present invention provides a connector including a housing and at least one inserting pin. The housing includes at least one groove and at least one plug receiving hole. The inserting pin is secured by the groove. The inserting pin includes a resilient leg for being electrically connected to a plug received in the housing.

To sum up, in the connector of the present invention, the inserting pin and the connecting pin are directly secured or engaged in the insulating housing. It doesn't require any bracket and position process between the housing and the bracket, thereby reducing the manufacturing time, the connector size, and the manufacturing cost.

BRIEF DESCRIPTION OF THE DRAWINGS

The present invention will become more fully understood from the subsequent detailed description and accompanying drawings, which are given by way of illustration only, and thus are not limitative of the present invention, and wherein.

DETAILED DESCRIPTION OF THE INVENTION

The present invention will be apparent from the following detailed description, which proceeds with reference to the accompanying drawing.

Figure 1A:
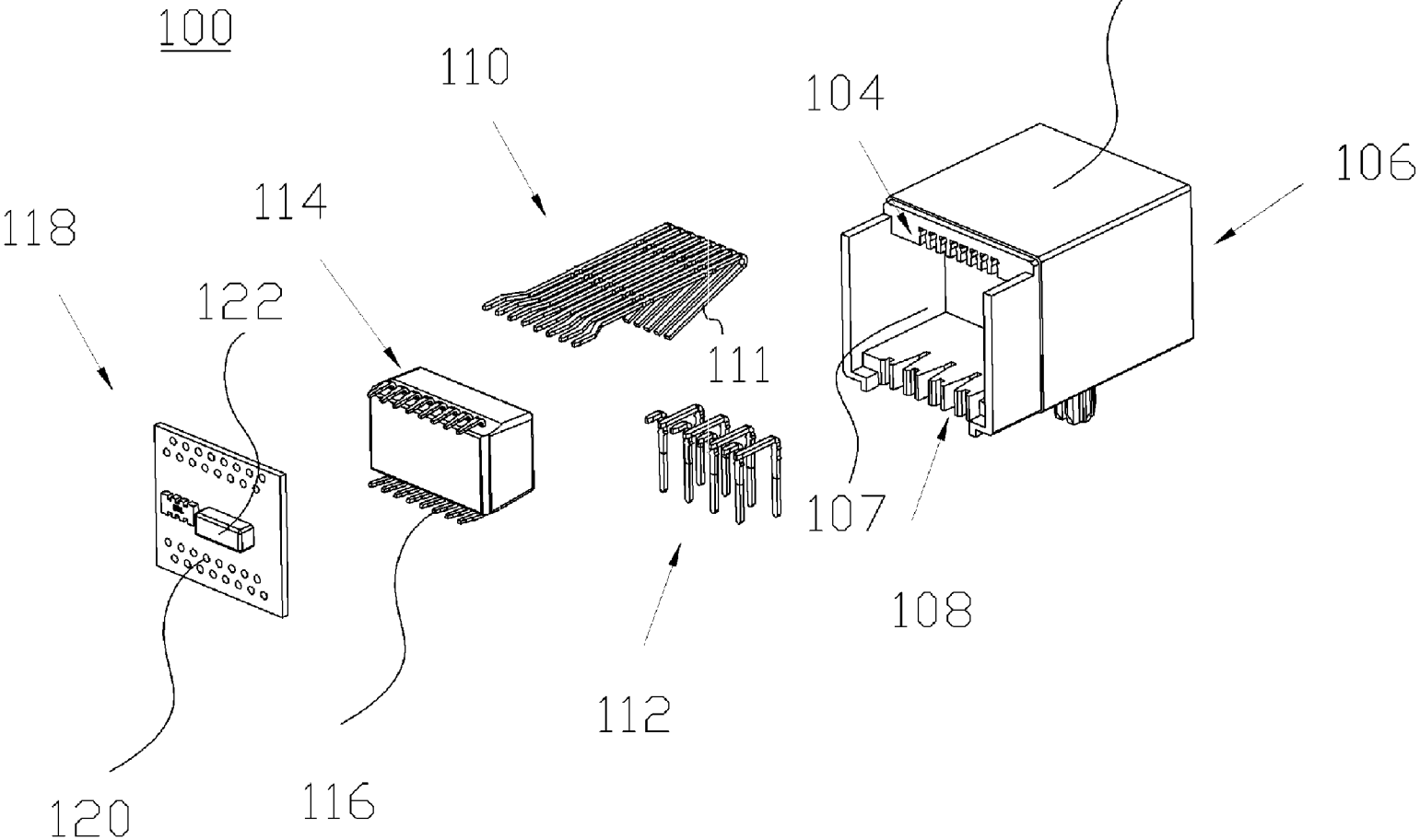
FIG. 1A is an exploded view of a phone jack connector according to a preferred embodiment of the present invention.

FIG. 1A is an exploded view of a phone jack connector according to a preferred embodiment of the present invention.

Figure 1B:
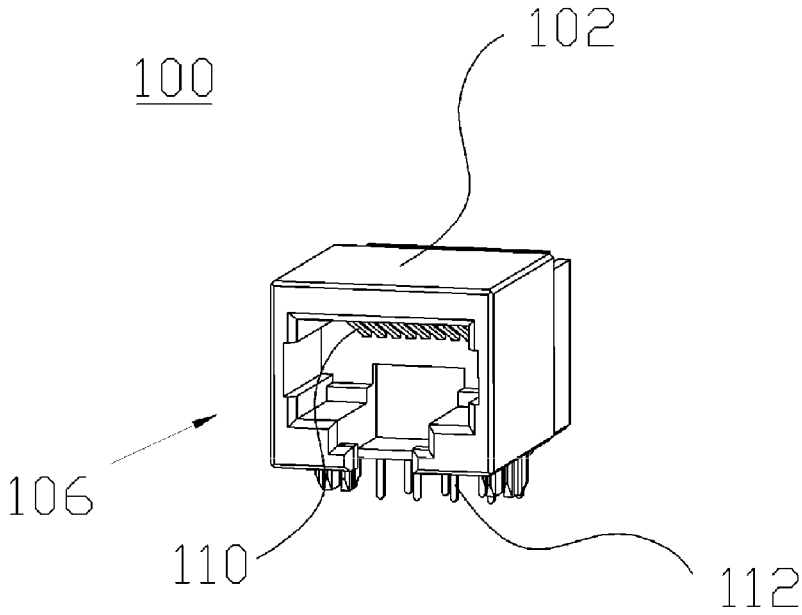
FIG. 1B and FIG. 1C are perspective views of the phone jack connector shown in FIG. 1A from two different sides.
Figure 1C:
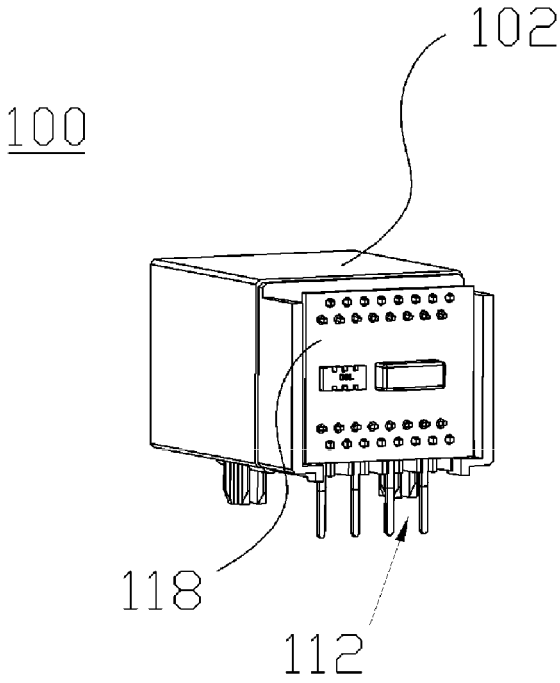

FIG. 1B and FIG. 1C are perspective views of the phone jack connector shown in FIG. 1A from two different sides. The phone jack connector 100 can be a USB connector, RJ11 connector or RJ45 connector. The phone jack connector 100 includes an insulating housing 102 having at least one groove 104 and at least one inserting pin 110 correspondingly secured by the groove 104. The inserting pin 110 is line-shaped, V-shaped, L-shaped, M-shaped, F-shaped, Z-shaped, N-shaped, T-shaped or U-shaped. The groove 104 is V-shaped, N-shaped, M-shaped or X-shaped. The inserting pin 110 includes a resilient leg 111 to be electrically connected to a plug received in the insulating housing 102.

The phone jack connector 100 further includes at least one connecting pin 112. The insulating housing 102 further includes at least one engaging hole 108. The engaging hole 108 is preferable a engaging slot. The connecting pin 112 is correspondingly engaged with the engaging hole 108, and secured by the engaging hole 108. The connecting pin 112 is electrically connected to an outside element, such as a printed circuit board. The connecting pin 112 is L-shaped, M-shaped, F-shaped, Z-shaped, N-shaped, T-shaped or U-shaped. The engaging hole 108 is V-shaped, N-shaped, M-shaped or X-shaped.

The phone jack connector 100 further includes at least one transformer module 114 having at least two sets of pins 116 respectively electrically connected to the inserting pin 110 and the connecting pin 112. The transformer module 114 includes at least one transformer and/or at least one choke. The insulating housing 102 defines a plug receiving hole 106 at a front side thereof and a rear receiving hole 107 at a rear side thereof, the transformer module 114 is disposed in the rear receiving hole 107. The plug receiving hole 106 is communicated with the rear receiving hole 107. The plug receiving hole 106 receives a USB plug, a RJ11 plug or a RJ45 plug.

The phone jack connector 100 further includes at least one printed circuit board 118 including at least one electrical device 122 thereon. The electrical device 122 can be a resistor or a capacitor. The printed circuit board 118 has a plurality of through holes 120. The pins 116, the inserting pin 110 and the connecting pin 112 are inserted in the plurality of through holes 120. Therefore, the printed circuit board 118 can be electrically connected to the connecting pin 112, the inserting pin 110 and the pins 116. The at least one set of pins 116 and the inserting pin 110 are electrically connected onto the printed circuit board 118 for allowing the pins 116 to be electrically connected to the inserting pin 110. The pins 116 and the connecting pin 112 are electrically connected onto the printed circuit board 118 for allowing the pins 116 to be electrically connected to the connecting pin 112.

To sum up, in the phone jack connector of the present invention, the inserting pin and the connecting pin are directly secured in insulating housing. It doesn't require any bracket and position process between the insulating housing and the bracket, thereby reducing the manufacturing time, the phone jack connector size, and the manufacturing cost.

Although the present invention has been described with reference to specific embodiment, this description is not meant to be construed in a limiting sense. Various modifications of the disclosed embodiment, as well as alternative embodiments, will be apparent to persons skilled in the art. It is, therefore, contemplated that the appended claims will cover all modifications that fall within the true scope of the present invention.

What is claimed is:

1. A connector comprising:

a housing having at least one groove; and at least one inserting pin correspondingly secured by the groove;

further comprising at least one connecting pin, wherein the housing further comprises at least one engaging hole, and the connecting pin is correspondingly engaged in the engaging hole and secured by the engaging hole;

further comprising at least one transformer module having at least two sets of pins respectively electrically connected of the inserting pin and the connecting pin;

wherein the housing defines a plug receiving hole at a front side thereof and a rear receiving hole at a rear side thereof, the transformer module is disposed in the rear receiving hole, and the plug receiving hole communicates with the rear receiving hole.

2. The connector according to claim 1, wherein the inserting pin comprises a resilient leg for being electrically connected to a plug received in the housing.

3. The connector according to claim 1, wherein the inserting pin is line-shaped, V-shaped, L-shaped, M-shaped, F-shaped, Z-shaped, N-shaped, T-shaped or U-shaped.

4. The connector according to claim 1, wherein the groove is V-shaped, N-shaped, M-shaped or X-shaped.

5. The connector according to claim 1, wherein the connecting pin is electrically connected to an outside element.

6. The connector according to claim 5, wherein the outside element is a printed circuit board.

7. The connector according to claim 1, wherein the connecting pin is L-shaped, M-shaped, F-shaped, Z-shaped, N-shaped, T-shaped or U-shaped.

8. The connector according to claim 1, wherein the engaging hole is V-shaped, N-shaped, M-shaped or X-shaped.

9. The connector according to claim 1, wherein the transformer module comprises at least one transformer and/or at least one choke.

10. The connector according to claim 1, wherein the plug receiving hole receives a USB plug, a RJ11 plug or a RJ45 plug.

11. The connector according to claim 1, further comprising at least one printed circuit board comprising at least one printed wiring, at least one electrical device thereon and a plurality of through holes.

12. The connector according to claim 11, wherein the pins of the transformer module, the inserting pin and the connecting pin are inserted into the plurality of through holes such that the printed circuit board is electrically connected to the connecting pin, the inserting pin and the pins of the transformer module.

13. The connector according to claim 11, wherein the electrical device comprises a resistor or a capacitor.

14. The connector according to claim 1, wherein the connector is a USB connector, RJ11 connector, RJ45 connector or phone jack connector.

15. The connector according to claim 1, wherein the housing is made of insulating material.

16. A connector, comprising:

a housing having a plug receiving hole at a front side and a rear receiving hole at a rear side;

a plurality of grooves formed in the housing for receiving insertion pins;

a plurality of holes formed in the housing for receiving connection pins; and a printed circuit board having a plurality of through holes for receiving ends of the insertion pins and connection pins, said printed circuit board closing the rear receiving hole.

* * * * *